US005503084A

United States Patent [19]

Goding et al.

[11] Patent Number: 5,503,084

[45] Date of Patent: Apr. 2, 1996

[54] DEVICE FOR IMPROVING WARP STIFFNESS OF A RAILCAR TRUCK

[75] Inventors: David J. Goding, Palos Park; V. Terrey Hawthorne, Lisle, both of Ill.

[73] Assignee: Amsted Industries Incorporated, Chicago, Ill.

[21] Appl. No.: 323,888

[22] Filed: Oct. 17, 1994

[51] Int. Cl.[6] ..... B61F 15/00

[52] U.S. Cl. ..... 105/218.1; 105/220; 105/224.1; 105/167

[58] Field of Search ..... 105/218.1, 218.2, 105/220, 224.05, 224.1, 225, 182.1

[56] References Cited

U.S. PATENT DOCUMENTS

| | | | |
|---|---|---|---|
| 2,782,732 | 2/1957 | Rossell | 105/225 |
| 3,621,792 | 11/1971 | Lich | 105/224.1 |
| 3,862,606 | 1/1975 | Scales | 105/224.05 |
| 4,170,180 | 10/1979 | Houston | 105/225 |
| 4,258,629 | 3/1981 | Jackson et al. | 105/224.1 |
| 4,674,412 | 6/1987 | Mulcahy et al. | 105/224.1 |
| 4,870,914 | 10/1989 | Radwill | 105/206.2 |

FOREIGN PATENT DOCUMENTS

| | | | |
|---|---|---|---|
| 1294410 | 5/1969 | Germany | 105/218.1 |

OTHER PUBLICATIONS

"Truck Hunting in the Three–Piece Freight Car Truck", by V. T. Hawthorne, P.E. Presented at the Winter Annual ASME Meeting, New York, NY, Dec. 2–7, 1979.

Goding, Patent Appln. No. 08/180,026, filed Jan. 11, 1994 for an Improved Truck Pedestal Design.

*Primary Examiner*—Mark T. Le

*Attorney, Agent, or Firm*—Edward J. Brosius; F. S. Gregorczyk

[57] ABSTRACT

A structural device is attached to each sideframe pedestal jaw of a railcar truck wherein the bearing adapter is joined to the sideframe and is prevented from rotating within the pedestal jaw opening. The bearing adapter inboard and outboard faces maintain a parallel relationship with the sideframe inboard and outboard faces during operations, including curving, thereby causing the truck axles to remain at a right angle with respect to the sideframes. Maintaining this right angular relationship substantially curtails truck wheel misalignment, which directly effects truck hunting and curving.

17 Claims, 3 Drawing Sheets

DEVICE FOR IMPROVING WARP STIFFNESS OF A RAILCAR TRUCK

FIELD OF THE INVENTION

The present invention relates to three-piece railroad car trucks and more particularly to a device which rigidly secures the truck pedestal jaw bearing adapter to the sideframe as a means for preventing the bearing journal from angling within the pedestal jaw. By precisely holding the bearing adapter within the pedestal jaw and preventing it from rotationally moving, an increase in the truck warp stiffness can be obtained. A greater truck warp stiffness directly corresponds to a higher resistance to truck hunting, thereby improving truck curving and high speed stability.

BACKGROUND OF THE INVENTION

In a conventional railway truck of the four-wheel type, the truck geometry is such that the axles are constrained by the sideframes and bearing adapters to remain substantially parallel to each other under most conditions of operations. It is generally desirable that a ninety degree, or right angular relationship be maintained between the axled wheelsets and the sideframes during travel on straight and curved track.

If there are small differences in the longitudinal dimensional tolerances of the sideframe pair wheelbases, or if there are track inputs which cause angular movement between the bearing, the bearing adaptor, and the sideframe, or longitudinal movement of the bearing adapter within the sideframe pedestal jaw, an unsquare condition known as lozenging will occur. Lozenging is where the sideframes operationally remain parallel to each other, but one sideframe moves slightly ahead of the other in a cyclic fashion; this condition is also known as parallelogramming or warping. Warping causes wheel misalignment with respect to the track; it is more pronounced on curved track and usually provides the opportunity for a large angle-of-attack to occur, as will be explained shortly. Ideally, it is desirable if the axles could align themselves with the radial axis of the tracks, as with the "steerable" type of trucks, where no angle-of-attack occurs. See FIG. 3A. However, with non-steerable trucks, this does not occur and the tracks work against the wheeled axles, forcing them to cause the truck to assume an out-of-square or warped condition. An out-of-square truck travelling through curved track results with a large angle of attack, defined herein as θ, the angle between the wheel flanges and the wheel rails. See FIG. 3B. A good compromise between a steerable truck and one which is easily warped, is a truck which will remain square (unwarped), resulting with a low angle of attack and a higher threshold speed at which truck hunting will occur, like the one of FIG. 3C. Past research efforts have noted a significant relationship between truck warping and resultant truck hunting.

Truck hunting is a continuous wheel set instability where the truck weaves down the track in an oscillatory fashion, usually with the wheel flanges striking against the rail, creating wheel drag. Surprisingly, this means that drag can occur even on straight track. Under truck hunting and dragging conditions, a substantial amount of frictional wear occurs between the wheel and track, wasting a great deal of locomotive horsepower and fuel in overcoming the friction forces. These conditions can also cause lading damage to vibration sensitive ladings, such as automobiles.

To improve curving associated with truck warping, prior art structures interposed elastomeric devices between the bearing adapter and the sideframe as a means for maintaining the wheelsets and sideframes in a generally right angular relationship with respect to each other while traveling on straight track. These devices were said to significantly reduce truck misalignment by providing a sufficiently resistive shear stiffness against lateral sideframe impacts, thereby assisting or maintaining the right angular relationship between the sideframes and wheelsets. Generally, it was recognized as being undesirable to transmit any source of perturbation through the axle, sideframe, and bolster, and these types of prior art devices intended to accomplish a damping of the disturbances rather than suppressing their initiation. A sideframe structure incorporating this type of prior art device is shown in U.S. Pat. No. 4,674,412, which is assigned to AMSTED Industries, Inc. of Chicago, Ill., the assignee of the present disclosure. Although this device helped prevent truck lozenging in curves, the truck warp stiffness remained unchanged.

Adding positioning lugs to each of the sideframe pedestal jaws as a means for preventing possible lozenging problems on a newly assembled truck was the subject of currently-pending application Ser. No. 180,026, filed on Jan. 11, 1994, and commonly owned by the assignee of this disclosure. The positioning lugs correct built-in lozenging which results from wheelbase dimensional tolerances, although they do not fully eliminate bearing adapter movement within the pedestal jaw.

SUMMARY OF THE INVENTION

By the present invention, it is proposed to overcome the inadequacies encountered heretofore by using a means which locks the bearing adapter within the sideframe pedestal jaw opening, thereby increasing the warp stiffness of the railcar truck since the truck axles are restrained from permutating from their right angular relationship with the sideframes. To this end, the means for increasing the warp stiffness prevents the bearing adapter from rotating within the pedestal jaw opening, namely preventing rotation about a vertical axis which is substantially perpendicular to the pedestal jaw roof. Preventing the bearing adapter from rotating effectively "fixes" the adapter in place and causes the axle to maintain its right angular relationship with the sideframe, thereby eliminating movements which normally lead to truck warpage. By eliminating the potential of the truck to warp, the truck is structurally more resistant towards becoming out-of-square.

In addition, if a resilient member like that of U.S. Pat. No. 4,674,412 is used within the pedestal jaw opening, the structure of the present invention further provides favorable vertical adapter displacement within the freedom of movement provided by the pedestal so that the vertical movement of each sideframe relative to the bearing adapter can be accommodated, while still preventing truck warpage.

Pursuant to the present invention, provision is made to provide a means for increasing the truck warp stiffness at each sideframe pedestal jaw. Each means generally consists of a pair of tie bars which join the bearing adapter to the sideframe, and all tie bars are machined to the same dimensional sizes. A separate tie bar respectively attaches to the inboard or outboard bearing adapter faces on one end, and to a respective inboard or outboard sideframe anchoring pad on its other end. The common ends of each tie bar pair are joined by a respective common anchoring pin or bolt so that system integrity is established.

Another feature of the structure of the present invention is that the tie bars establish consistent truck wheelbase dimensions. This means that if the longitudinal distances between respective front or back pedestal jaw centerlines on each sideframe vary, that variance can be eliminated by using the tie bars to respectively locate each bearing adapter within its respective pedestal jaw opening such that the same wheelbase dimensions are established between each of the sideframes comprising the truck assembly. Furthermore, since the tie bars do not limit the lateral freedom of the bearing adapter within the pedestal jaw opening, the truck will be able to assume positions coincident with the radii of curvature of the track being negotiated.

Further features of the present invention will be apparent after reading the detailed description of the invention in conjunction with the following drawings:

DESCRIPTION OF THE PREFERRED EMBODIMENT

Figure 1:
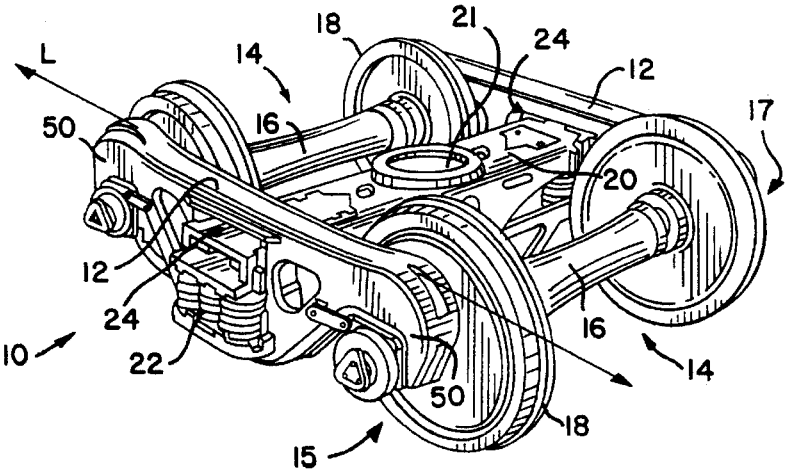
FIG. 1 is a perspective view of a railway truck incorporating the present invention.

Referring now to FIG. 1, there is shown a railway vehicle truck 10 incorporating the present invention. The truck 10 generally comprises a pair of sideframes 12 mounted on spaced wheelsets 14. Each wheelset 14 is comprised of an axle 16, to which are mounted wheels 18, and roller bearings 25. Each of the sideframes 12 also include a bolster opening 24 in which a bolster 20 is resiliently supported by springs 22. Bolster 20 is connected to a railcar underside by means of a centrally-located center plate 21.

Figure 5:
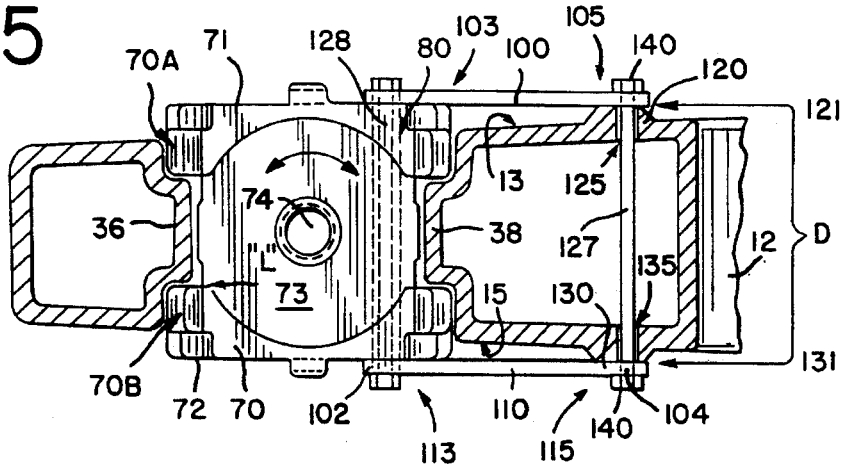
FIG. 5 is a top view showing detailing how the bearing adapter is longitudinally secured to the sideframe and prevented from rotating within the pedestal jaw opening.
Figure 4:
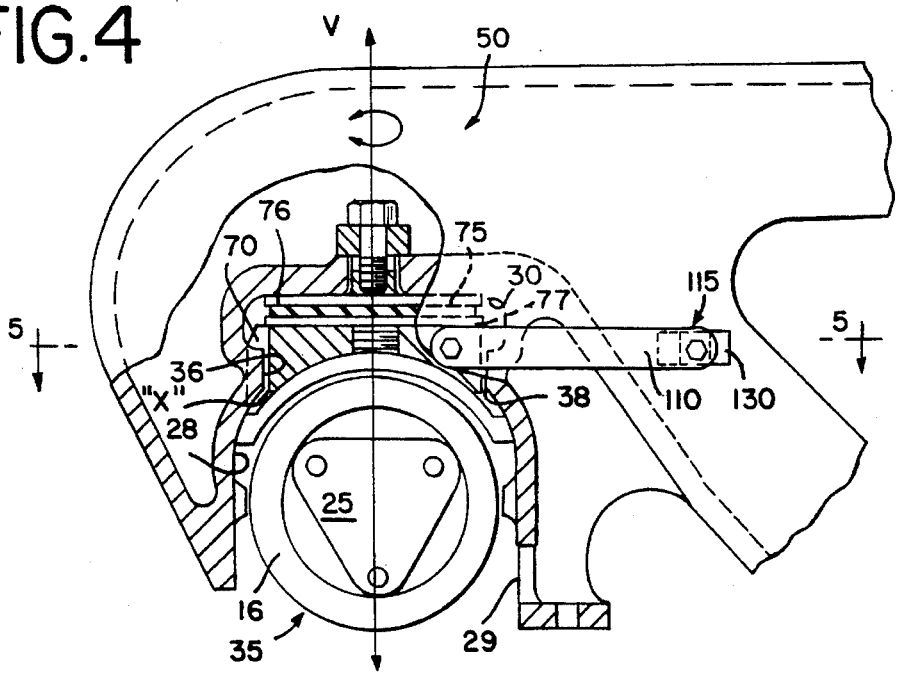
FIG. 4 is a fragmentary view of a sideframe end illustrating the position of the present invention in relation to the bearing adapter and the raised tie bar anchoring pads.
Figure 2A:
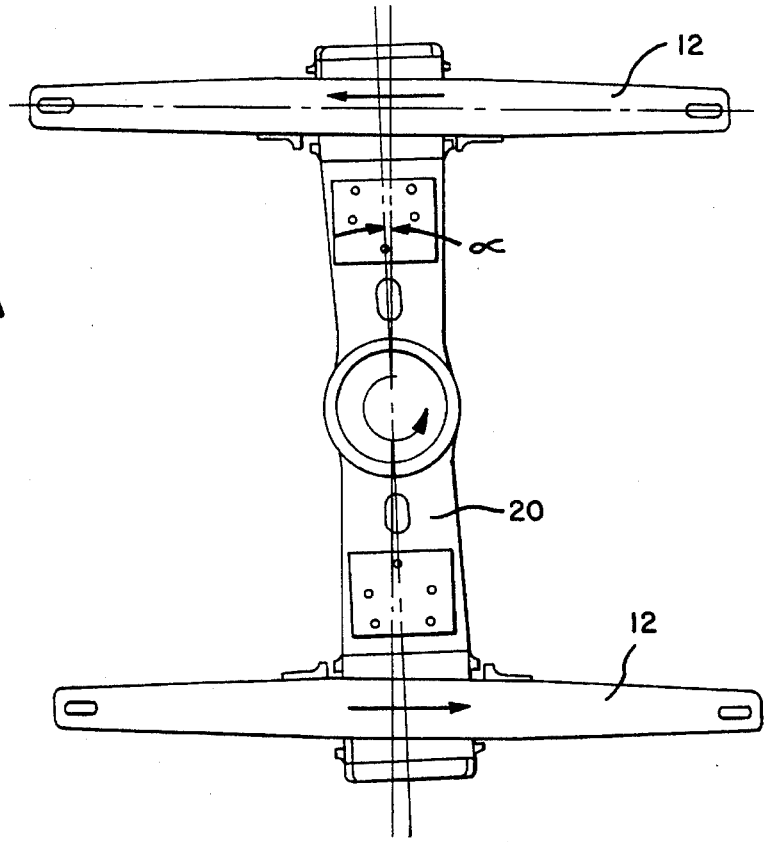
FIG. 2A is a top view of a parallelogrammed truck.
Figure 2B:
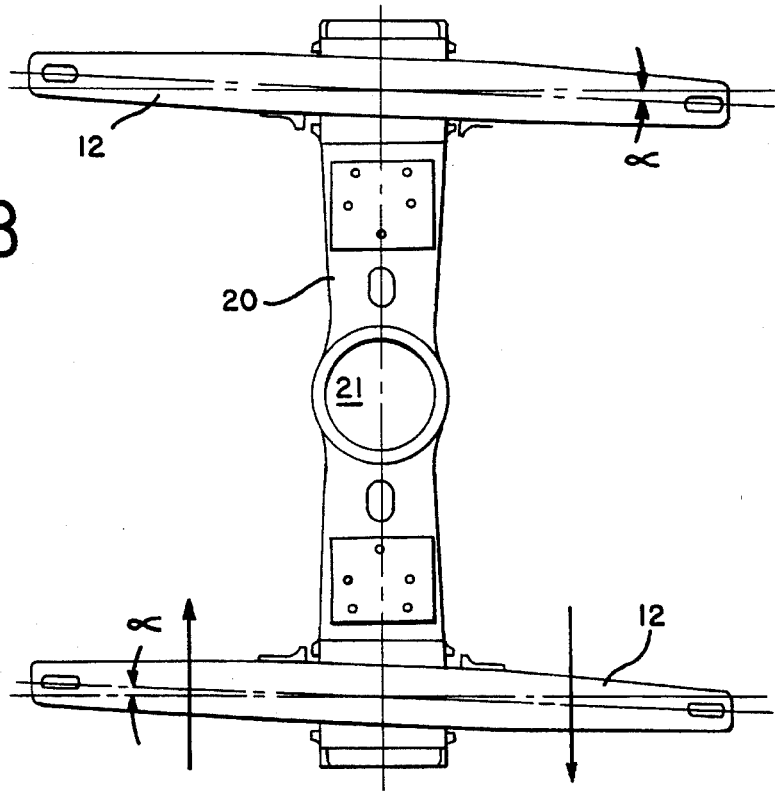
FIG. 2B is a top view of an out-of-square truck.
Figures 3A, 3B, 3C:
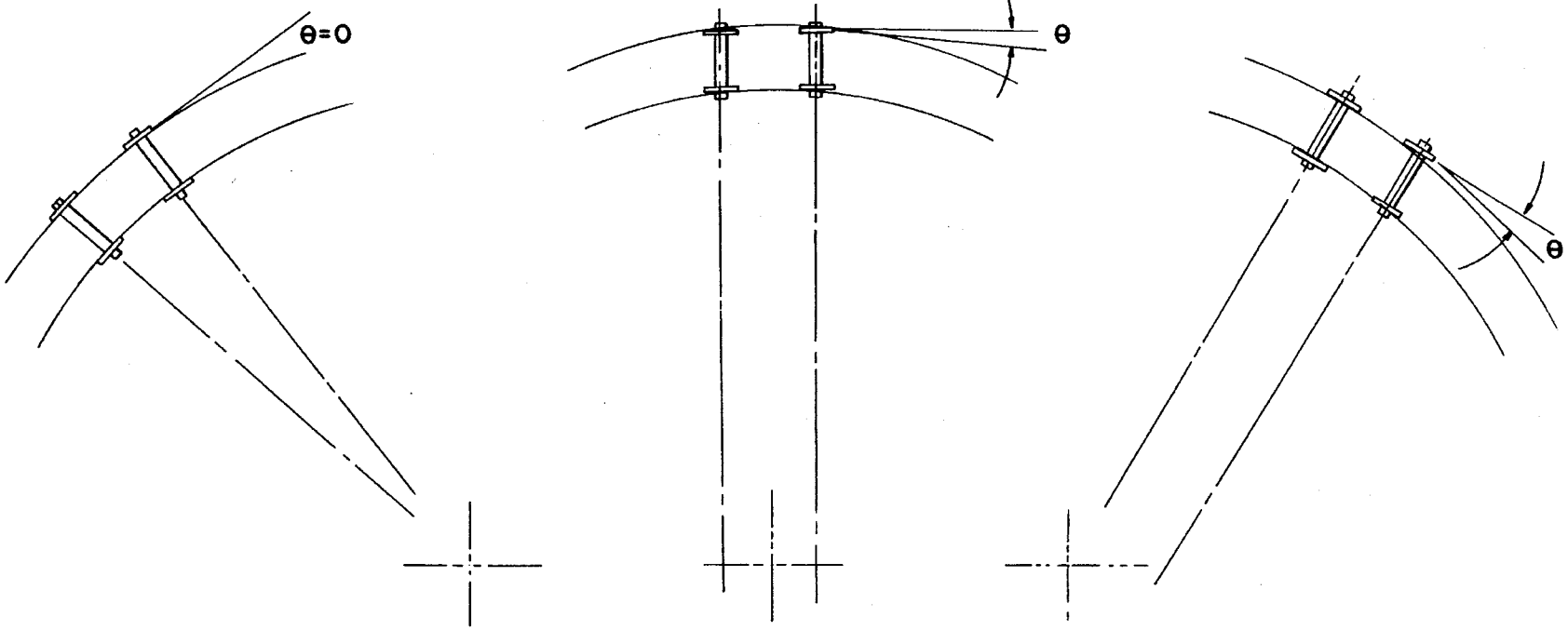
FIG. 3A is diagrammatic view of a steerable truck on curved track emphasizing no angle of attack between the wheel flanges and the rails.
FIG. 3B is diagrammatic view of an out-of-square truck on curved track with a very high angle of attack.
FIG. 3C is a diagrammatic view emphasizing that a squared truck can exhibit a very low angle of attack even without the truck exhibiting steerable capabilities.

FIG. 4 illustrates that each sideframe end is composed of a pedestal jaw 50 which is formed by a first vertical wall 28 and a second vertical wall 29 interconnected to a pedestal jaw roof 30. The vertical walls are longitudinally spaced to define a pedestal jaw opening 35 which receives the wheeled axle 16. Each pedestal jaw opening 35 also includes a bearing adapter 70 mounted to roof 30 for holding axle roller bearing 25 in place on axle 16, as well for transferring absorbed bearing forces into the pedestal jaw area. As best seen from viewing FIG. 5, the bearing adapter 70 traverses the entire width of pedestal jaw 50. A pair of opposed and horizontally disposed pedestal thrust lugs 36,38, precisely position bearing adapter 70 longitudinally between each lug to specific tolerances so that the bearing adapter and axle is longitudinally centered within each respective jaw opening 35. The tolerances for the particular truck design of the present invention, marked "X" in FIG. 4, are set at 0.030 inches, and with these specific tolerances, the axles will be able to longitudinally move with respect to the sideframes and negotiate a turn having 7.5 radius of curvature. Trucks which must negotiate tighter curves must have larger tolerances provided here. The thrust lugs 36,38 also function to limit the longitudinal displacement of each bearing adapter within the pedestal jaw opening and it should be clear that when the bearing adapter movement is limited, axle roller bearings 25 are likewise limited. As FIG. 5 illustrates, bearing thrust lugs 36,38 laterally extend between respective inboard and outboard bearing adapter post sections 70A and 70B, which are respectively located on both the front and back comers of bearing adapter 70. Lateral tolerance or freedom between posts 70A and 70B exists, herein designated as "L", such that bearing adapter 70 is capable of limited transverse movement within pedestal jaw opening 35 so that truck 10 can negotiate turns.

Depending upon the type of truck, is it is possible that each bearing adapter might be coupled with a bearing adapter isolator (See FIG. 4), which includes an elastomeric pad 75 that effectively behaves as a resistive spring for pulling and holding the bearing adapter and axle so that the right angular relationship between the sideframes and the wheeled axles can be retained after the truck has experienced a turn or track irregularity. The elastomeric pad 75 is made from any commercial material exhibiting a lateral shear rate of at least 75,000 to 150,000 pounds per inch and a compressive load rate between about 100,000 and 200,000 pounds per inch; they should also have a value of about 40 to 60 in durometer when using the Shore D scale at a temperature of 70° F. As the FIG. 4 illustrates, pad 75 is sandwiched between a pair of steel plates 76,77, which function to hold pad 75 in place during shearing. Without these plates, the pad wear life would be substantially shortened. If the particular truck does not use a bearing isolator, it is to be understood that the top face 73 of bearing adapter 70, would be flat and not require the round indentation as currently shown in FIG. 5. Also, the body of the bearing adapter would extend upwards until it touched pedestal jaw roof 30, thereby displacing the area occupied by plates 76,77, and pad 75. (See FIG. 4). It necessarily follows that the isolator hole 74 would also not be required, and therefore, would not be present.

Having appreciated the previous discussion of the prior art devices used for developing a squared truck exhibiting high warp stiffness, attention is now directed FIGS. 4 and 5, where a sideframe incorporating the warp stiffening means of the present invention is shown. These figures detail the relationship between the sideframe 12 and the bearing adapter 70, and more particularly, emphasing that the present invention is comprised of a pair of tie bars 100,110 at each sideframe pedestal jaw 50 which are respectively anchored to an inboard and outboard face 13,15 of sideframe 12 and to respective inboard and outboard faces 71,72 of each bearing adapter 70. The tie bar pair at each pedestal jaw functions to secure the bearing adapter 70 to sideframe 12 in the longitudinal direction and by doing so, more importantly prevents the adapter from twisting, or rotating within the pedestal jaw opening. The rotational displacement which is being prevented by the structure of the present invention is best seen by viewing the directional arrow shown in FIG. 5. In conjunction with FIG. 5, it should be clear from FIG. 4 that the rotational displacement referred to above, is that which moves about a vertical axis "V", which is substantially perpendicular to the pedestal jaw roof 30. Operationally, tie bars 100,110 hold or lock the bearing adapter 70 within the pedestal jaw opening 35 such that the bearing adapter faces 71,72 always remain parallel to the sideframe faces 13,15. Those in the art refer to the bearing adapter as being held "square" to the sideframe, and when this is done, the axles cannot seek an out-of-square position with respect to the sideframes. This necessarily means that the axles will remain at right angles with respect to the sideframes, and because of this, the truck is then considered "squared". As previously mentioned, a truck exhibiting a high warp stiffness, is a truck which remains squared during all phases of travel, whether on straight or curved track.

In that respect, it is to be understood that the exact position of each of the tie bars 100,110 is very important to the proper operation of this invention since the tie bars directly control the longitudinal position of each bearing adapter and ultimately, the position of each axle within the pedestal jaw openings 35 respective of each of the sideframes. Since each of the tie bars 100,110, the tie bar anchoring pads 120,130, and the pedestal jaws 50, are respectively identical members, only one such member will be described in greater detail although that description will equally apply to the other member.

In accordance with the present invention, both of the inboard and outboard faces of each sideframe 12 include respective inboard and outboard tie bar anchoring pads 120,130, integrally cast as part of sideframe and located a like longitudinal distance rearward of second pedestal jaw wall 29. All anchoring pads 120,130 are preferably of rectangular configuration and equal in dimensional size, with the longer side of the pad generally coincidental with the longitudinal axis of the sideframe. It is preferable to dispose the anchoring pads 120,130 as such for two reasons. First of all, a greater extent or portion of each pad 120,130 will be coincidental with their respective rearward ends 105,115 of each tie bar 100,110 thereby providing a greater surface area for the tie bar to act upon when distributing forces into the sideframe. Secondly, aligning the longer side of the pad with the length of the tie bar ensures that there will be longitudinal latitude in locating a tie bar anchoring point. This becomes important for properly setting wheelbase distances between each sideframe so that they exactly match. This point will be described in greater detail later on in the disclosure.

It is also important that each anchoring pad 120,130 be precisely machined to ensure that each individual pad outwardly projects off its respective sideframe face 13 or 15, by equal extents. In this way, neither of the tie bars will be cocked with respect to the bearing adapter or sideframe faces when they are connected to the sideframe. By that it is meant that each anchoring pad height can dictate whether a respective inboard or outboard tie bar will remain substantially parallel to its respective inboard or outboard bearing adapter face and sideframe face. As FIG. 5 illustrates, the distance "D" between each of the anchoring pad surfaces 121,131, is equal to the distance between the bearing adapter faces 71,72. Otherwise, if the distance "D" was greater or less than the width of the bearing adapter, an inward or outward skewness would be introduced into the warp stiffening means structure, causing a preexisting twisting of the bearing adapter within the pedestal jaw opening even before the truck was placed into service. As previously described, any twisting of the bearing adapter would lead to truck yawing and hunting.

Instead of machining the tie rod anchoring pads from the as-cast sideframe material, steel shims (not shown) could be welded to corresponding positions on the inboard and outboard faces 13,15 of the sideframe as a substitute method for creating the pad. In either case, a precision drilled throughbore 125,135 is drilled into each anchoring pad 120,130 for accepting an elongate stud 127 therethrough. For the sake of precision, it is envisioned that the sideframe be laid on either of its inboard or outboard sides, with only one drill press pass being performed so that each pad throughbore is perfectly in alignment with the other. Stud 127 is of any suitable high strength steel and it is preferable to use a stud threaded only on its distal ends in order to exhibit higher bending strength characteristics. As FIGS. 4 and 5 illustrate, stud 127 has a length sufficient for cumulatively spanning the width of sideframe 12, the height of both anchoring pads, while still having enough thread length for accepting lock washer and nut sets 140.

Likewise, bearing adapter 70 includes a single bore 73 extending through its width, and it is important to precision drill this bore so that the bore is substantially at a right angle with respect to both lateral side faces 71,72 of bearing adapter 70. It is also important to precision drill bearing adapter bore 80 so that it will exactly align with the front tie bar holes 102 on each of the tie bar front ends 103,113 in order to properly receive the bearing adapter stud 128. Stud 128 is of the same diameter as anchor stud 127 and of the same type of height strength steel, although it will be slightly shorter in length since the extent of the width of sideframe 12 is actually smaller at the pedestal jaw area than it is at the anchoring pad 120,130.

When out of a resting position or a substantially straight operating position, it should be understood that the lateral freedom "L" which has been purposely provided to the bearing adapter, allows the truck to still successfully negotiate turns despite the fact that the tie bars are holding the bearing adapter in place and not allowing it to twist. Lateral displacement of each of the tie bars also takes place by an equal distance, however, since the rear end portions 105,115 of each tie bar are effectively stationary, each tie bar will behave like a simply supported beam. It necessarily follows that each tie bar be made from a material which can withstand the flexing a simply supported beam would experience under the same loading conditions without experiencing fatigue. Therefore, it is envisioned that each tie bar 100,110 be made from a mild steel. It is also important that each tie bar be machined preferably from flat stock so that each bar is an exact duplicate of each other. This point is most critical with respect to consistently providing center-to-center distances between the front and back holes 102, 104. If these centerline distances are not exact between tie bars, a premature skewing of the bearing adapter 70 will result once the anti-warping device is attached, as was described.

Another important aspect of the present invention is that the distance of the longitudinal wheelbase, can be consistently provided from sideframe to sideframe, thereby ensuring that each assembled truck will always have axles that will remain in the right angular relationship with respect to the sideframe. This feature is very critical because with prior art truck operations, it was discovered that even though the sideframes were being cast to proper specified tolerances, the cast dimensions between pedestal jaws were varying from sideframe to sideframe. This resulted with the assembled wheelbase dimensions to be inconsistent between the sideframes of the same truck, with the variations occasionally causing the axle(s) to be tight against the bearing adapter, with a slight longitudinal displacement of the bearing adapter within the pedestal jaw. This condition necessarily meant that a possibility existed where axle 16 could be slightly cocked within each pedestal jaw even though the pedestal thrust lugs are first machined in order to precisely position the bearing adapter. Although the cocking might never exceed a few thousandths of an inch, it was determined that the truck could develop a substantial amount of resultant drag on tangent track. Furthermore, the initial axle displacement within the pedestal jaw longitudinally restricted the axle from moving as desired within jaw opening 20 because the axles would contact a pedestal jaw wall before the allowed travel tolerance was exhausted. If the truck was of the type which used a bearing adapter isolation pad 75, the uneven wheelbase dimensions would cause a slight longitudinal displacement of the bearing adapter within the pedestal jaw opening as a result of the pad incurring a slight shearing displacement, such that bearing adapter 70 was no longer in a neutral or centered position within the pedestal jaw opening when the truck was placed into service. The tie bars of the present invention prevent can account for and eliminate the as-cast dimensional wheelbase inconsistencies by knowing the shortest distance between pedestal jaw centers, and then using the tie bars and anchoring pads to set the bearing adapter at each pedestal jaw so that same shortest wheelbase dimension is reproduced on the other sideframe wheelbase.

The foregoing description has been provided to clearly define and completely describe the present invention. Various modifications may be made without departing from the scope and spirit of the invention which is defined in the following claims.

What is claimed is:

1. An improved truck for a railway vehicle having a longitudinal axis, said truck including a pair of longitudinally extending and laterally spaced sideframes, said sideframes each having a first end with a first pedestal jaw, a second end with a second pedestal jaw, an inboard face and an outboard face, each of said first and second pedestal jaws formed by a vertically disposed forward wall, a vertically disposed rearward wall, and a horizontally disposed pedestal roof interconnecting said forward and rearward walls, each said pedestal jaw forward and rearward walls and said pedestal roof defining a pedestal jaw opening, each pedestal jaw opening including a vertical axis substantially perpendicular to said pedestal jaw roof, a plurality of wheel bearing adapters, each said pedestal jaw opening accommodating a wheel bearing adapter, at least one axle, each said axle having a first axle end and a second axle end, a plurality of bearing assemblies, one of said bearing assemblies mounted on each said axle end, each said sideframe pedestal jaw having a bearing adapter mounted within said pedestal jaw opening, each said bearing adapter having an inboard face and an outboard face, each of said first and second pedestal jaws including a set of horizontally aligned thrust lugs for longitudinally centering and laterally restraining said bearing adapter within said pedestal jaw opening, the improvement comprising:

means for rigidly joining each of said bearing adapters to said sideframe inboard and outboard faces to prevent said bearing adapter from rotational movement about said pedestal jaw vertical axis, to maintain each said axle end and said sideframe at a substantially right angular relationship, and to increase truck warp stiffness, said rigidly joining means allowing said bearing adapter to retain limited lateral freedom within said pedestal jaw opening, said lateral freedom being transverse to said longitudinal axis, said rigidly joining means at each said sideframe pedestal jaw including a pair of connection members mounted at each said sideframe pedestal jaw, a first of said connection members coupling said adapter and sideframe inboard faces and a second of said connection members coupling said adapter and sideframe outboard faces, each of said first and second connection members having a front end with a front hole and a rear end with a rear hole, each said front end connected to a respective said bearing adapter and each said rear end connected to said sideframe at an anchoring point on each said respective sideframe inboard and outboard face.

2. The railway truck of claim 1, wherein each said pair of connection members has a first tie bar and a second tie bar, and each said anchoring point is comprised of an anchoring pad joined to each of said sideframe faces, said sideframe having an inboard and an outboard anchoring pad at each said pedestal jaw, wherein each said anchoring pad is located a substantially equal longitudinal distance rearward of said pedestal jaw.

3. The railway truck of claim 2 wherein said first tie bar of said tie bar pair has said front end connected to said inboard face of a respective bearing adapter and said second tie bar of said same tie bar pair has said front end connected to said outboard face of said bearing adapter.

4. The railway truck of claim 3 wherein each said first tie bar of said tie bar pair has said rear end connected to a respective inboard anchoring pad, and each said second tie bar of said tie bar pair has said rear end connected to a respective outboard anchoring pad, each of said inboard and outboard anchoring pads projecting laterally outward off said respective face of said sideframe a substantially equal extent.

5. The railway truck of claim 4 wherein each of said inboard and outboard anchoring pads has it rectangular configuration with a long side, each said long side generally horizontally disposed and at a substantially equal distance rearward of said pedestal jaw and generally parallel with said pedestal jaw roof.

6. The railway truck of claim 5 wherein said first and second tie bars of each said tie bar pair are substantially parallel to each other and to said longitudinal axis.

7. The railway truck of claim 6 wherein said tie bar pairs on each said sideframe are substantially parallel to each other.

8. The railway truck of claim 7 wherein each said pedestal jaw bearing adapter has a throughbore extending between said inboard and outboard bearing adapter faces, said throughbore extending at substantially a right angle to said longitudinal axis of said sideframe.

9. The railway truck of claim 8 wherein said inboard and outboard anchoring pads near each said pedestal jaw are in an opposed position to each other, each said inboard and outboard anchoring pad having an aperture, said inboard and outboard apertures in alignment and extending between said inboard and outboard anchoring pads and through said sideframe.

10. The railway truck of claim 9 further comprising a plurality of front bolts, rear bolts and means for fastening said bolts, each said bolt having a first end and a second said front end of each of said first and second tie bars of said tie bar pair is connected to said respective bearing adapter by one of said front bolts, said one front bolt laterally extending through said bearing adapter throughbore and each of said front holes in each of said first and second tie bars, and fastening means secured to each of said front bolt first and second ends.

11. The railway truck of claim 10, wherein said rear end of each of said first and second tie bars of said tie bar pair is connected to said respective anchoring pad by one of said rear bolts, said one rear bolt laterally extending through each of said inboard and outboard anchoring pad apertures, said sideframe and each said rear holes in each of said first and second tie bar rear ends, and fastening means secured to each of said rear bolt first and second ends.

12. The railway truck of claim 11 further including an elastomeric device disposed between said bearing adapter and said pedestal jaw roof, said elastomeric device including in upper plate, a lower plate, and an elastomeric pad interposed between said upper plate and said lower plate, wherein said means for securing said bearing adapter and said elastomeric device allows said bearing adapter to experience a rolling motion and a vertical motion within said pedestal jaw opening, said vertical motion generally normal to said longitudinal axis, and said rolling motion defined as an arcuate motion along said longitudinal axis.

13. An improved sideframe of a railway truck having a longitudinal axis, a first end with a front pedestal jaw, a second end with a rear pedestal jaw, an inboard face and an outboard face, each of said first and second pedestal jaws formed by having a vertically disposed forward wall, a vertically disposed rearward wall, and a horizontally disposed pedestal roof interconnecting said forward and rearward walls, each said pedestal jaw forward and rearward walls and said pedestal roof defining a pedestal jaw opening, each of said pedestal jaw openings including a vertical axis centered within said opening, said vertical axis substantially perpendicular to said pedestal jaw roof, a plurality of wheel bearing adapters, each said pedestal jaw opening accommodating a wheel bearing adapter, at least one axle, each said axle having a first axle end and a second axle end, a plurality of bearing assemblies, one of said bearing assemblies mounted on each said axle end, each said first and second pedestal jaws including a set of horizontally aligned thrust lugs for longitudinally centering and laterally restraining said bearing adapter within said pedestal jaw opening, the improvement comprising:

means for rigidly joining each said bearing adapter to said inboard and outboard faces to prevent said bearing adapter from rotational movement about said pedestal jaw vertical axis, and to maintain each said axle end at a substantially right angular relationship with said sideframe, in order to increase truck warp stiffness, said rigidly joining means allowing said bearing adapter to retain limited lateral freedom within said pedestal jaw opening, said lateral freedom transverse to said longitudinal axis, said rigidly joining means at each said pedestal jaw including a pair of connection members mounted at each said sideframe pedestal jaw, a first of said connection members coupling said adapter and sideframe inboard faces and a second of said connection members coupling said adapter and sideframe outboard faces, each of said first and second connection members having a front end with a front hole and a rear end with a rear hole, each said front end connected to said bearing adapter and each said rear end connected to said sideframe at an anchoring point on each said respective sideframe inboard and outboard faces.

14. The railway truck sideframe of claim 13, wherein each said pair of connection members has a first tie bar and a second tie bar, and each said anchoring point is comprised of an anchoring pad joined to each of said sideframe faces, said sideframe having an inboard and an outboard anchoring pad at each said pedestal jaw, wherein each said anchoring pad is located a substantially equal longitudinal distance rearward of said pedestal jaw.

15. The railway truck sideframe of claim 14 wherein said first tie bar of said tie bar pair has said front end connected to said inboard face of a respective said bearing adapter and said second tie bar of said same tie bar pair has said front end connected to said outboard face of said same respective said bearing adapter, said first tie bar rear end connected to said inboard anchoring pad and said second tie bar rear end connected to said outboard anchoring pad, each said inboard and outboard anchoring pads having a rectangular configuration with a long side, said inboard and outboard anchoring pads projecting laterally outward off said respective face of said sideframe by an equal extent, said first and second tie bars of said tie bar pairs being substantially parallel to each other and to said longitudinal axis, each said inboard and outboard anchoring pads located a substantially equal rearward distance of said pedestal jaw, said long side of each respective said anchoring pad generally horizontally disposed and substantially parallel with said pedestal jaw roof.

16. The railway truck sideframe of claim 15 further comprising a plurality of front bolts, rear bolts and means for fastening, each said front and rear bolt having a first end and a second end, each said pedestal jaw bearing adapter having at least one throughbore extending between said inboard and outboard bearing adapter faces, said throughbore extending at substantially a right angle to said longitudinal axis of said sideframe, said first and second tie bar front end front holes aligned with said bearing adapter throughbore, said front bolt laterally extending through said bearing adapter throughbore and each of said front holes in said first and second tie bars, and fastening means secured to each of said front bolt first and second ends, said inboard and outboard anchoring pads in an opposed position to each other and having an aperture, said respective apertures being coaxial and horizontally aligned, and extending between said inboard and outboard sideframe faces, each said first and second tie bar rear end rear holes aligned with said respective anchoring pad aperture, said rear bolt laterally extending through said apertures and said first and second tie bar rear end holes, and fastening means secured to each of said rear bolt first and second ends.

17. The railway truck sideframe of claim 16 further including an elastomeric device disposed between said bearing adapter and said pedestal jaw roof, said elastomeric device including an upper plate, a lower plate, and an elastomeric pad interposed between said upper plate and said lower plate, wherein said means for securing said bearing adapter and said elastomeric device allows said bearing adapter to experience a rolling motion and a vertical motion within said pedestal jaw opening, said vertical motion generally normal to said longitudinal axis and said rolling motion defined as an arcuate movement along said longitudinal axis.

* * * * *